US006311525B1

(12) United States Patent
Marker et al.

(10) Patent No.: US 6,311,525 B1
(45) Date of Patent: Nov. 6, 2001

(54) NON-RUN FITTED BED SHEET

(75) Inventors: Ulrich Marker; Fred E. Hunneke, both of Kinston, NC (US)

(73) Assignee: Domestic Fabrics Corporation, Kinston, NC (US)

( * ) Notice: Subject to any disclaimer, the term of this patent is extended or adjusted under 35 U.S.C. 154(b) by 0 days.

(21) Appl. No.: 09/618,814

(22) Filed: Jul. 18, 2000

(51) Int. Cl.[7] ..... D04B 1/00; A47G 9/00
(52) U.S. Cl. ..... 66/170; 5/497
(58) Field of Search ..... 66/169 A, 169 R, 66/170, 172 R, 198, 199; 5/482, 495, 496, 497; 442/304, 306, 312

(56) References Cited

U.S. PATENT DOCUMENTS 1,081,779 * 12/1913 Scott ..... 66/169
2,350,359 * 6/1944 Krasnov et al. ..... 66/169
2,429,187 * 10/1947 Krasnov et al. ..... 66/169
2,624,893 * 1/1953 Harris ..... 5/497
2,657,561 * 11/1953 Saunders ..... 66/169
3,392,552 * 7/1968 Muller et al. ..... 66/169
3,430,462 * 3/1969 Nebel et al. ..... 66/169
4,308,626 * 1/1982 Weiss ..... 5/497
4,723,331 * 2/1988 Weiss ..... 5/497
4,941,331 * 7/1990 Cournoyer et al. ..... 66/25
5,029,353 * 7/1991 Kimball et al. ..... 5/497
5,031,425 * 7/1991 Cournoyer et al. ..... 66/196
5,765,241 * 6/1998 Macdonald ..... 5/497

* cited by examiner

*Primary Examiner*—Danny Worrell
(74) *Attorney, Agent, or Firm*—Coats & Bennett, PLLC

(57) ABSTRACT

A fitted bed sheet having a stretchable knit construction that includes inherent elastic qualities sufficient to enable the bed sheet to be stretched over and around a mattress. Specifically, the fitted bed sheet is of a knit construction and includes a series of knitted loop courses formed by yarns knitted into a series of consecutive loops. Formed at selected intervals between the knitted loop courses is a series of intermediate courses. Each intermediate course is disposed between one or more knitted loop courses and formed by a repeating pattern of knit, miss and tuck stitches. This particular construction results in an inherently elastic or stretchable knit construction that permits the fitted sheet to be pulled and stretched over a mattress without requiring a sewn-in elastic band.

30 Claims, 3 Drawing Sheets

NON-RUN FITTED BED SHEET

FIELD OF THE INVENTION

The present invention relates to bed sheets, and more particularly to a fitted bed sheet having a stretchable knit construction that resists runs and which enables the bed sheet as a whole to be stretched and fitted around a mattress.

BACKGROUND OF THE INVENTION

Bed sheets used by institutions such as hospitals are subject to extensive wear conditions. Such wear, of course, comes about through use. In addition to ordinary bed use, sheets typically found in hospitals and other institutions are subjected to extensive wear and tear simply through repeated laundry, which often is aggressive.

In the end, this treatment and the resulting wear have a significant effect on the durability and longevity of such sheets. It is not uncommon for such sheets to begin to run after such wear and these runs tend to progress to the point that the sheets start to unravel and tear. Once this happens, the sheets must be discarded.

Further, many institutional bed sheets tend to be of the fitted type. These fitted bed sheets include elastic sewn-in the perimeter of the sheets. Once the elastic has been subjected to repeated laundry and wear, the elastic has a tendency to loose its strength and elasticity. This obviously results in the fitted sheets not fitting snuggly and smoothly around the mattress.

Therefore, there has been and continues to be a need for a durable fitted bed sheet that is resistant to runs.

SUMMARY OF THE INVENTION

The present invention entails a bed sheet that is designed to be run resistant. Further, in one embodiment of the present invention, the bed sheet assumes the form of a fitted bed sheet and comprises a knit construction that includes inherent elastic qualities that enable the sheet to be stretched and fitted over a mattress without requiring a conventional sewn-in elastic band.

More particularly, the knit construction of the sheet comprises a series of two different knitted courses. The first type of course is referred to as a knitted loop course and is formed by yarns knitted to yield a series of consecutive loops along a respective course. The second type of course is referred to as an intermediate course. These intermediate courses are formed between selected knitted looped courses and the yarns that form the intermediate courses are formed in a repeating pattern of knit, miss, and tuck stitches.

In one embodiment of the present invention, the knitted loop courses and the intermediate courses are arranged in a repeating pattern of at least six courses. In this embodiment, there is provided at least two knitted loop courses disposed in side by side relationship. At selected intervals within the repeating pattern, one finds the intermediate courses. That is, one or more intermediate courses are disposed between two or more knitted loop courses.

In one particular embodiment of the present invention, the knit and tuck stitches of the intermediate courses are off set with respect to each other, while a miss stitch is formed between each knit and tuck stitch in such a fashion that the miss stitches are generally aligned within the repeating pattern.

This knit construction gives rise to a bed sheet that has two principal advantages. First, the knit construction described above results in a bed sheet that is run resistant. Secondly, this knit construction includes inherent elastic qualities that are sufficient to enable the bed sheet, when assuming a fitted form, to stretch over and be secured to a mattress.

Other objects and advantages of the present invention will become apparent and obvious from a study of the following description and the accompanying drawings which are merely illustrative of such invention.

DETAILED DESCRIPTION OF THE DRAWINGS

Figure 1:
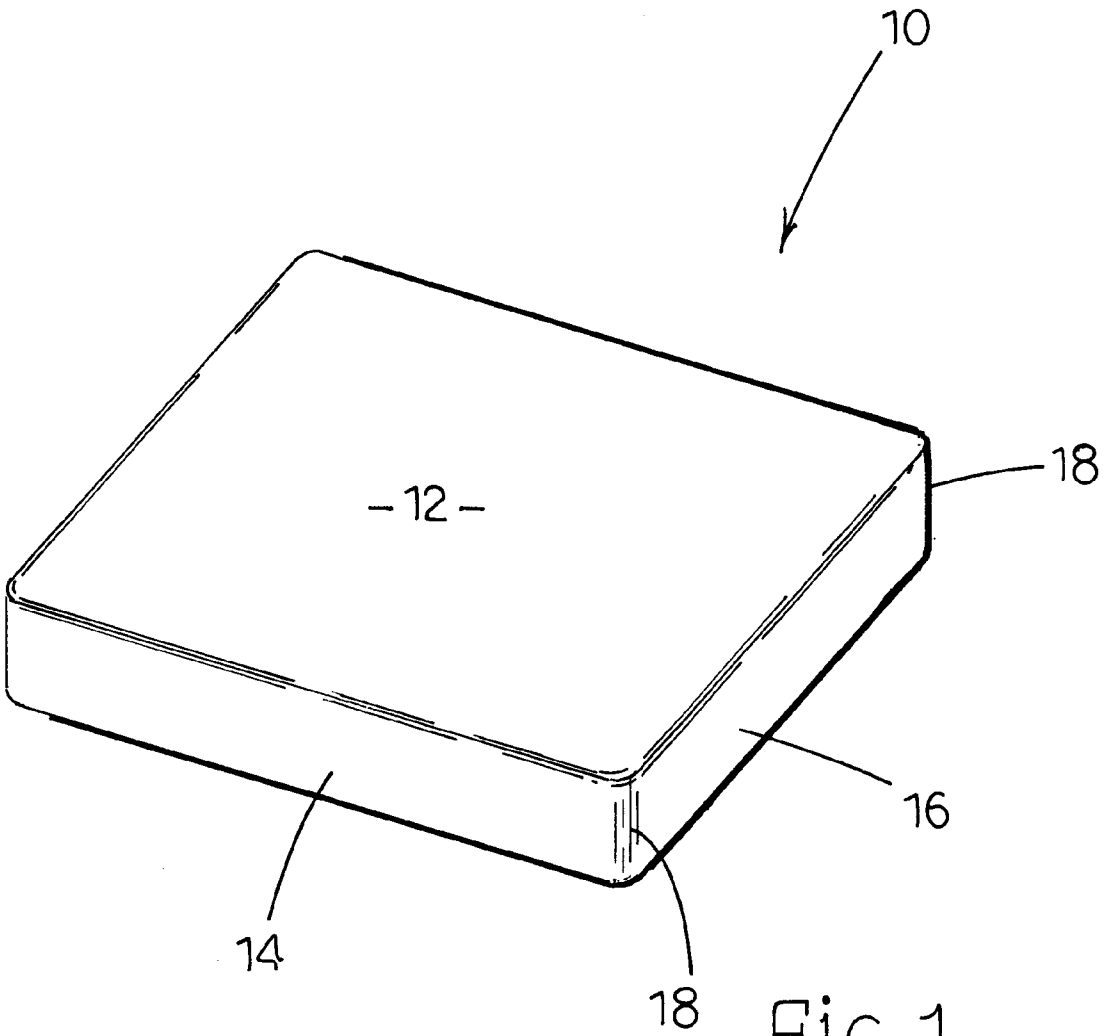
FIG. 1 is a perspective view of the sheet of the present invention.

With further reference to the drawings, the bed sheet of the present invention is shown therein and indicated generally by the numeral 10. In the case of the embodiment illustrated herein, bed sheet 10 assumes the form of a fitted sheet. In that regard, the bed sheet 10, as seen in FIG. 1, includes a central panel 12, a pair of side sections 14, a pair of end sections 16, and four corner areas 18.

Figure 2:
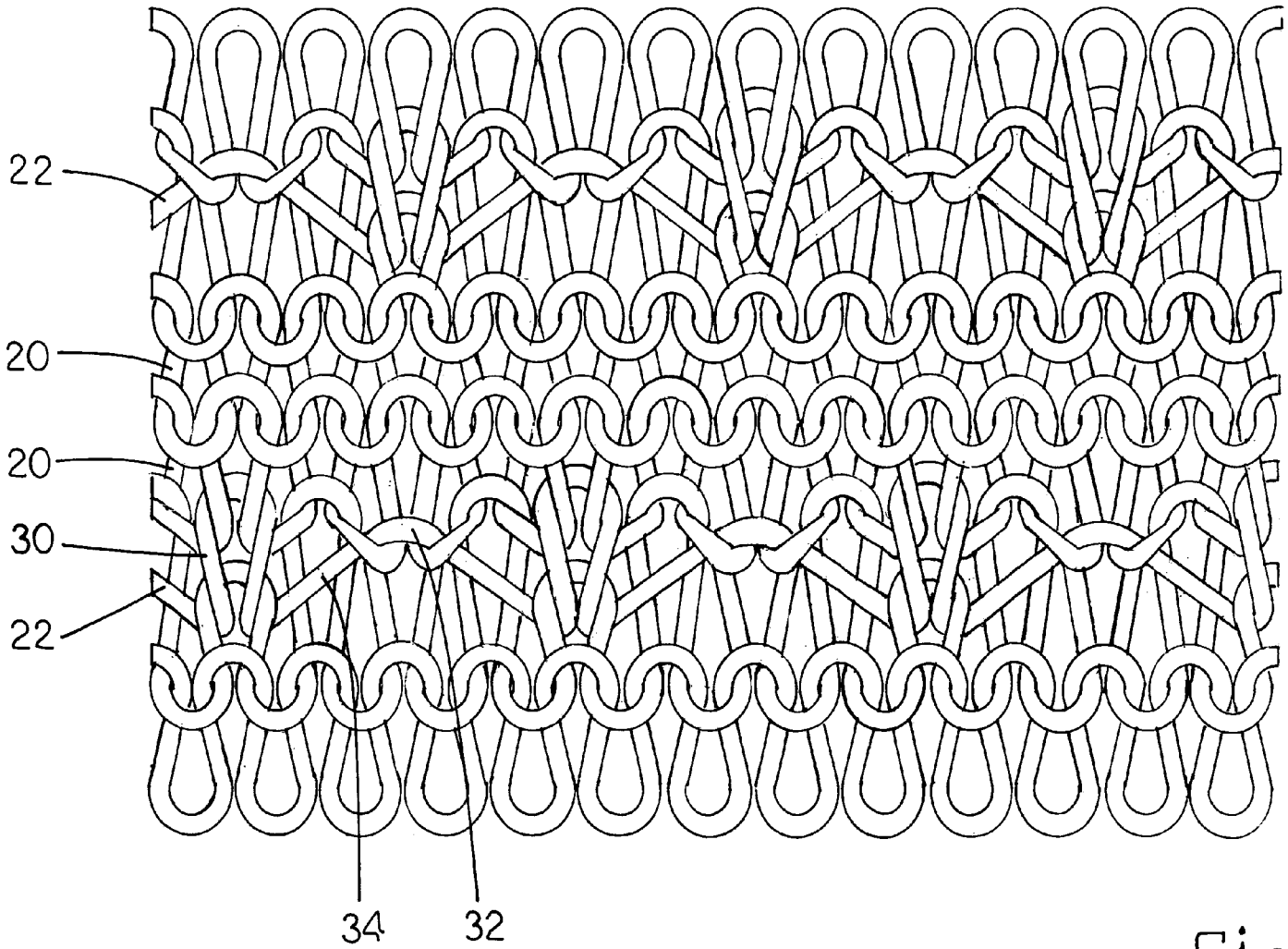
FIG. 2 is an enlarged and schematic illustration showing the knit construction of the fabric incorporated into the sheet design of the present invention.
Figure 3:
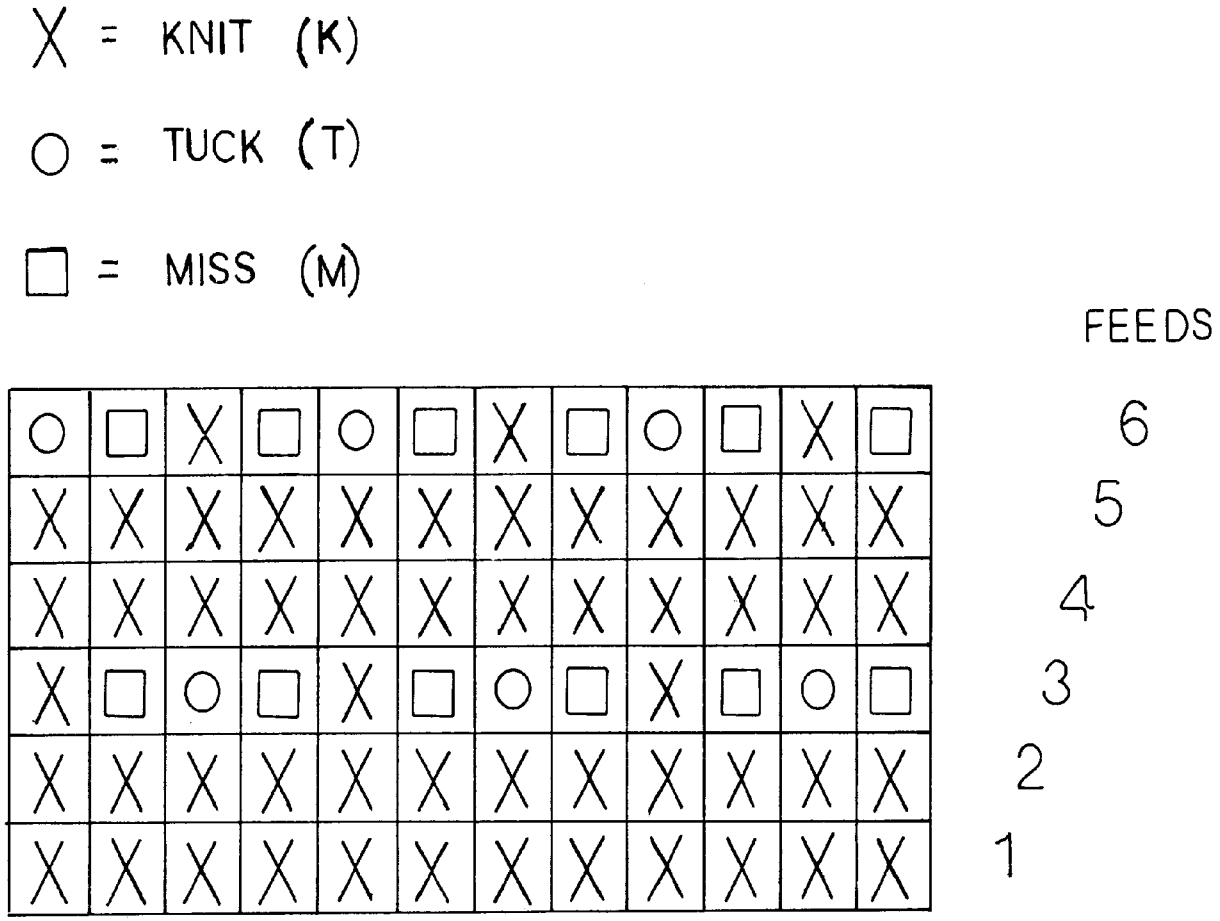
FIG. 3 is a knitting chart for the fabric illustrated in FIG. 2.

FIG. 2 illustrates the basic fabric construction of the bed sheet 10, which FIG. 3 is a schematic knitting chart for the fabric construction illustrated in FIG. 2. Basically, the fabric construction is made up of at least two different course constructions. These two course constructions are referred to as a knitted loop course 20 and an intermediate course 22. As illustrated in FIGS. 2 and 3, the fabric construction basically comprises a six course repeating pattern. It should be appreciated that the number of courses found in the repeating pattern may vary. In the embodiment illustrated herein, the repeating pattern includes two knitted loop courses 20 followed by a first intermediate course 22, followed by two knitted loop courses 20 followed by a second intermediate course. Essentially, as illustrated in FIGS. 2 and 3, the knitted courses 20 are arranged in pairs and are separated by a single intermediate course 22. Also, the knit and tuck stitches in the first and second intermediate courses are staggered with respect to one another, while the misses are aligned.

Now turning to the knitted loop courses 20, it is seen that they are of a conventional knit design. That is, each knitted loop course includes a series of consecutive loops 30 formed throughout a segment of the respective course. The intermediate courses 22, on the other hand, include a series of different stitches, formed one after the other. More specifically, as viewed in FIGS. 2 and 3, each intermediate course includes a yarn that is disposed between adjacent knitted loop courses and formed into a repeating pattern of knit, miss, and tuck stitches. The knit stitches are referred to by the numeral 30, the tuck stitches are referred to by the numeral 32, and the miss stitches are referred to by the numeral 34.

In the particular embodiment illustrated herein, in the intermediate courses 22, a knit stitch 30 is followed by a miss stitch 34 which in turn is followed by a tuck stitch 32. This scheme or design repeats itself throughout a selected segment of respective intermediate courses 22.

Once fabricated or knitted, it is seen that the tuck stitches and the knit stitches of adjacent intermediate courses 22 are offset with respect to each other. That is, as one moves from one intermediate course 22 to the next intermediate course, the relative positions of the knit and tuck stitches will alternate to form the offset arrangement just described. However, in the embodiment illustrated, the miss stitches 34 will occur between each knit stitch 30 and tuck stitch 32 and consequently the miss stitches 34 will be maintained in general alignment.

As seen in FIG. 3, for the six course repeating pattern illustrated herein, there would be six yarn feeds. For a fabric that is approximately 55% polyester and 45% cotton, a 50/50 poly-cotton yarn would be fed on feed numbers 1, 2, 4 and 5. A filament poly yarn would be fed on feed numbers 3 and 6. Although the denier of these yarns may vary, it is contemplated that a 300 denier yarn would be used in both cases. In a polyester and cotton configuration, the fabric weight would be on the order of 5.2–5.4 ounces per square yard. For a fitted sheet 80 to 84 inches long and 36 inches wide, this would yield a sheet weight of approximately 1.2 pounds.

There are a number of advantages associated with the knit construction described above. First, this particular knit construction yields a no-run sheet. That is, the construction of the intermediate course 22 and its integration into adjacent knitted loop courses 20 yields a knit pattern that is essentially run resistant. In addition, this same construction provides an elastic or stretchable design. In the embodiment illustrated herein, the design includes sufficient inherent elasticity to enable the fitted sheet to be stretched over and secured to a mattress without the requirement of a sewn-in elastic band that is conventionally found around the perimeter of the fitted sheet. Expressed in another way, the inherent elastic qualities of the above knit construction is sufficient to enable the sheet structure on its own to stretch and conform around the mattress in such a fashion that the sheet itself is secured to the mattress.

As used herein, the term course or courses means a segment or run of yarn that is formed into a knitted pattern of loops or a pattern of various stitches such as knit, miss or tuck stitches. The term course or courses does not mean or imply that the runs or segments are continuous, or of any particular length.

The present invention may, of course, be carried out in other specific ways than those herein set forth without departing from the spirit and the essential characteristics of the invention. The present embodiments are therefore to be construed in all aspects as illustrative and not restrictive and all changes coming within the meaning and equivalency range of the appended claims are intended to be embraced therein.

What is claimed is:

1. A bed sheet having a knit construction comprising a plurality of knitted loop courses formed by yarns knitted to yield a series of consecutive loops throughout the respective courses; and a plurality of intermediate courses formed between selected knitted looped courses, each of the intermediate courses being disposed between knitted loop courses and formed by a repeating pattern of knit, miss, and tuck stitches.

2. The bed sheet of claim 1 wherein a miss stitch is formed after each knit stitch and after each tuck stitch of the respective intermediate courses.

3. The bed sheet of claim 1 wherein the knit and tuck stitches of consecutive intermediate courses are offset with respect to each other.

4. The bed sheet of claim 3 wherein the miss stitches of consecutive intermediate courses are generally aligned and lie between the knit and tuck stitches.

5. The bed sheet of claim 1 wherein the knitted loop courses are arranged in pairs and are separated by at least a single intermediate course.

6. The bed sheet of claim 5 wherein the knitted loop courses and the intermediate courses form a pattern that includes two knitted loop courses followed by a single intermediate course which is followed by two knitted looped courses which in turn is followed by a single intermediate course, such that a six course repeating pattern is formed.

7. The bed sheet of claim 6 wherein the knit and tuck stitches of each six course pattern are staggered with respect to each other.

8. The bed sheet of claim 7 wherein the miss stitches of each six course pattern lie between each knit and tuck stitch of the pattern and are generally aligned.

9. A fitted bed sheet comprising a central section and a series of side and end sections for fitting around side and end portions of a mattress;

wherein the bed sheet substantially throughout includes a stretchable knit construction having inherently elastic qualities sufficient to enable the bed sheet to be stretched over and secured to the mattress; and wherein the knit construction comprises a plurality of knitted loop courses formed by yarns knitted to yield a series of consecutive loops throughout the respective courses; and a plurality of intermediate courses formed between selective knitted looped courses and including yarns formed into a repeating pattern of knit, miss, and tuck stitches and disposed between respective knitted loop courses.

10. The fitted bed sheet of claim 9 formed by a panel of material having the stretchable knit construction and four corner areas, and wherein each of the four corner areas are cut and stitched to form a corner construction that wraps around a corner of the mattress.

11. The fitted sheet of claim 9 wherein a miss stitch is formed after each knit stitch and after each tuck stitch within the respective intermediate course.

12. The fitted bed sheet of claim 9 wherein the knit and tuck stitches of consecutive intermediate courses are offset with respect to each other.

13. The fitted bed sheet of claim 12 wherein the miss stitches of consecutive intermediate courses are generally aligned and lie between the knit and tuck stitches.

14. The fitted bed sheet of claim 9 wherein the knitted loop courses are arranged and paired and are separated by at least a single intermediate course.

15. The fitted bed sheet of claim 14 wherein the knitted loop courses and the intermediate courses form a pattern that includes two knitted loop courses followed by a single intermediate course which is followed by two knitted loop courses which in turn is followed by a single intermediate course, such that a six course repeating pattern is formed.

16. The fitted bed sheet of claim 15 wherein the tuck and knit stitches of each six course pattern are staggered with respect to each other.

17. The fitted bed sheet of claim 16 wherein the miss stitches of each six course pattern lie between each knit and tuck stitch of the pattern and are generally aligned.

18. A method of forming a fitted bed sheet that includes a stretchable knit construction having inherent elastic qualities sufficient to enable the bed sheet to be stretched over and around a mattress, comprising:

a. forming a knitted fabric material having a multi-course repeating pattern by forming knitted loop courses having yarns knitted into consecutive loops throughout the courses;

b. forming intermediate courses between selected knitted loop courses wherein respective intermediate courses include a repeating pattern of knit, miss and tuck stitches; and c. forming the knitted fabric material into a fitted bed sheet having side and end panels and a series of corners for surrounding a mattress.

19. The method of claim 18 wherein the fitted bed sheet is formed by cutting a panel from the knitted fabric material and wherein the panel includes four corner areas, and thereafter cutting and stitching each of the four corner areas to form the four corners of the fitted bed sheet.

20. The method of claim 18 including forming a miss stitch after each knit stitch and after each tuck stitch in respective intermediate courses.

21. The method of claim 18 wherein the knit and tuck stitches of consecutive intermediate courses are offset with respect to each other.

22. The method of claim 21 wherein the miss stitches of consecutive intermediate courses are generally aligned and lie between the knit and tuck stitches.

23. The method of claim 18 wherein the knitted loop courses are arranged in pairs and separated by a single intermediate course.

24. The method of claim 23 wherein the knitted loop courses and the intermediate courses form a pattern that includes two knitted loop courses followed by a single intermediate course which is followed by two knitted loop courses which in turn is followed by a single intermediate course, so as to form a six course repeating pattern.

25. The method of claim 24 wherein the knit and tuck stitches of each six course pattern are staggered with respect to each other.

26. The method of claim 25 wherein the miss stitches of each six course pattern lie between each knit and tuck stitch of the pattern and are generally aligned.

27. The fitted bed sheet of claim 9, wherein the central section of the bed sheet is formed of a stretchable knitted construction having inherent elastic qualities sufficient to enable the bed sheet to be stretched over and secured to the mattress.

28. The fitted bed sheet of claim 27, wherein the side and end sections of the bed sheet are formed of a stretchable knitted construction having inherent elastic qualities such that the bed sheet as a whole includes a stretchable knit construction.

29. The fitted bed sheet of claim 10, wherein each of the four corner areas include substantially the same knit construction found throughout the fitted bed sheet.

30. A fitted bed sheet including central, side, end and corner sections for fitting around the top, side, end and corner portions of a mattress; and wherein all said sections are of a stretchable knit construction having inherent elastic qualities that allow the bed sheet as a whole to be stretched over and secured to the mattress.

* * * * *